US005079797A

United States Patent [19]

Ohshima et al.

[11] Patent Number: 5,079,797

[45] Date of Patent: Jan. 14, 1992

[54] CABINET LID STAY

[75] Inventors: Kazuyoshi Ohshima; Tatsuya Hayakawa, both of Tokyo, Japan

[73] Assignee: Sugatsune Industrial Co., Ltd., Tokyo, Japan

[21] Appl. No.: 465,787

[22] Filed: Jan. 17, 1990

[30] Foreign Application Priority Data

Jan. 18, 1989 [JP] Japan ..... 1-4338[U]
Jan. 23, 1989 [JP] Japan ..... 1-6148[U]

[51] Int. Cl.[5] ..... E05F 5/02
[52] U.S. Cl. ..... 16/82; 16/DIG. 9
[58] Field of Search ..... 16/1 C, 287, 289, 82, 16/DIG. 17, 85, 86 C, 347, 346, DIG. 40, DIG. 41, 49, 51, 371, 50, 54, 68, 375

[56] References Cited

U.S. PATENT DOCUMENTS

| | | | |
|---|---|---|---|
| Re. 23,191 | 1/1950 | Riley et al. | 16/86 C |
| 1,024,465 | 4/1912 | Voight | 16/DIG. 17 |
| 1,936,365 | 11/1933 | Raymond | 16/82 |
| 3,001,811 | 9/1961 | Erickson | 16/82 |
| 3,378,878 | 4/1968 | Flint et al. | 16/82 |
| 3,666,214 | 5/1972 | Matuska | 16/82 |

FOREIGN PATENT DOCUMENTS

| | | | |
|---|---|---|---|
| 18142 | of 1929 | Australia | 16/82 |
| 1435081 | 5/1976 | United Kingdom | 16/82 |

*Primary Examiner*—Richard K. Seidel
*Assistant Examiner*—Edward A. Brown
*Attorney, Agent, or Firm*—Fleit, Jacobson, Cohn, Price, Holman & Stern

[57] ABSTRACT

A cabinet lid stay is provided including a pair of arms pivotally coupled with each other for relative angular displacement at first ends of the arms and the second end of one arm is pivotally connected to a stationery cabinet portion through utilization of a damper construction while the second end of the second arm is pivotally connected to the cabinet lid through utilization of a pivot connector including a twist lock connection with a fixture mounted to the cabinet lid, the twist lock connection between the second arm and the fixture defining a relative rotation pivot axis of release therefore disposed in the plane of the arms. In addition, the first arm and mounting therefore to the stationery cabinet portion includes coacting structure by which pivoting movement of the first arm relative to the stationery cabinet portion may be adjustably limited to thereby limit the angular positioning of the cabinet lid when in its full open position.

3 Claims, 5 Drawing Sheets

CABINET LID STAY

BACKGROUND OF THE INVENTION

1. Field of the Invention

This invention relates to a stay that can be suitably used for swingably fitting a lid to a cabinet or the like and used to support the lid in adjusted open position.

2. Description of Related Art

Conventional stays generally incorporate very simple structure, are difficult to install and are ineffective to support a heavy vertically swingable lid or door in a partially open position. Further, conventional stays generally are not adjustable as to the angle at which the associated door may be held partially open and further are not of high grade quality.

SUMMARY OF THE INVENTION

The main object of the present invention is to provide a stay wherein the metal fitting member for a first of the arms is constituted by a releasable metal joint swingably fitted to an end of the first arm and a metal fixture to be rigidly fitted to the lid by means of screws and the releasable metal joint and the metal fixture are removably coupled together so that only the metal fixture may be rigidly fitted to the lid in advance and the metal fitting member for the other arm can be rigidly fitted to a side panel of the cabinet, after the metal joint is coupled with the metal fixture. With such an arrangement, the arms do not constitute any obstacles when the metal fitting members are fitted to the lid and the cabinet so that the fitting operation can be carried out accurately and efficiently in a very short period of time.

Another object of the present invention is to provide a stay having one of the arms thereof removably fitted by a metal fitting member to the movable shaft prepared separately from the damper in order to support the damper by the metal fitting member, wherein the one of the arms projects from an eccentric section of the damper and an adjuster screw for adjusting the angle with which the lid is retained at an open position from the cabinet also projects from the main body in such a manner that it can be driven into or out of the main body as it is revolved, while a retaining member to which the screw abuts when the lid is retained at the open position is provided on the metal fitting member so that the turning effort is transmitted to the eccentric section of the damper main body by way of the arm when the lid is open and therefore the damper can have an enhanced efficiency for transmission of turning effort in order to make the operation of opening and closing the lid much easier than that of any comparable cabinet provided with a conventional stay as the combination of the screw and the metal fitting member constitute a retainer for retaining the plate lid at a certain open position and therefore the angle of the lid relative to the cabinet at said open position can be modified and adjusted with ease.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 6:
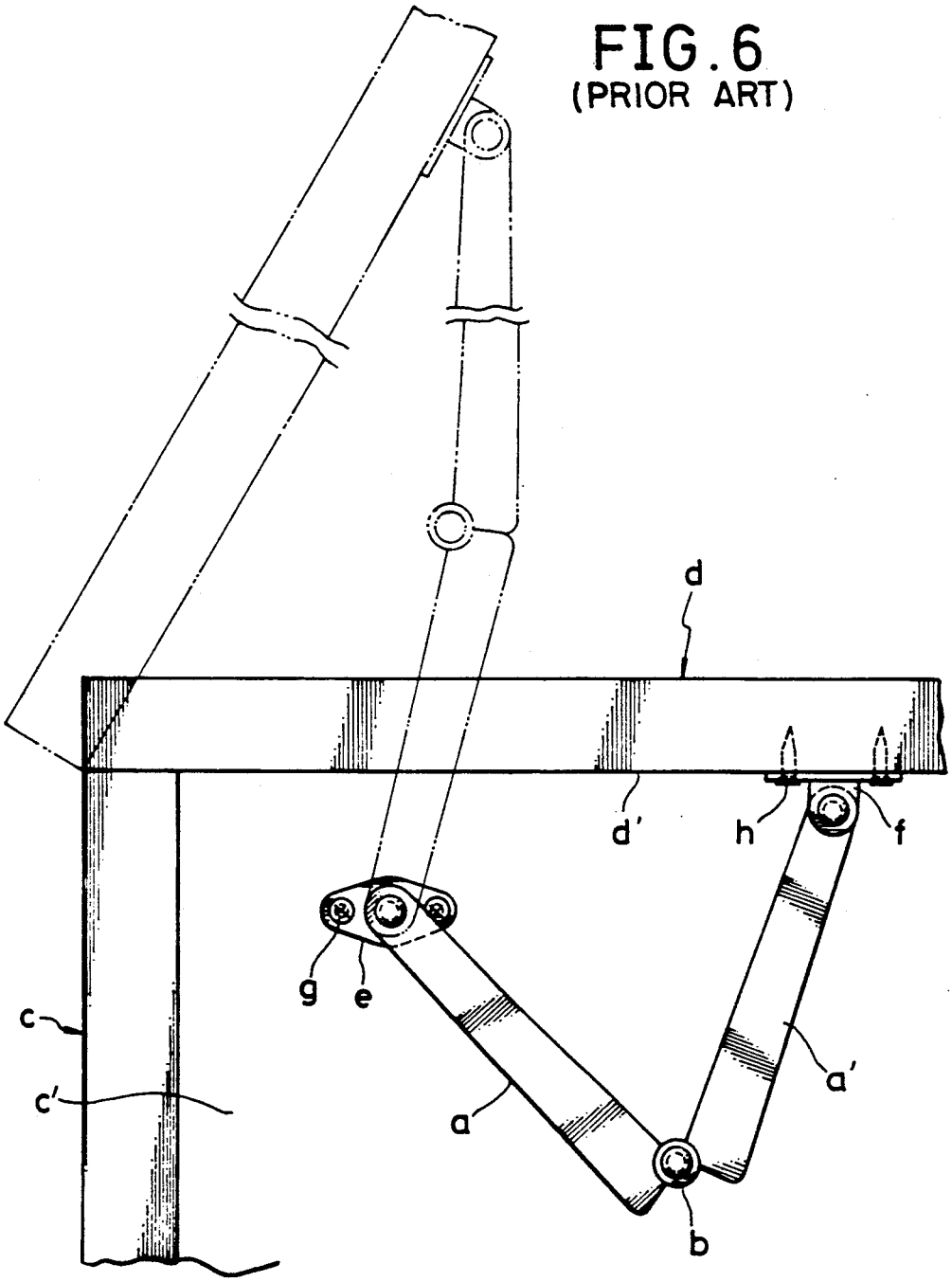
FIG. 6 (PRIOR ART)
FIGS. 6 and 7 respectively show a conventional stay and a conventional stay having a damper.

FIG. 6 of the accompanying drawings illustrates a conventional stay having a very simple structure. It comprises a pair of arms a, a' articulately connected with each other at their one ends by means of a shaft b that functions as axis of rotation so that the arms can rotate relative to each other. Such a stay may be fitted to a cabinet c and a plate lid d to make the lid d swingable and capable of being held at a given open position by firmly attaching metal fitting members e, f swingably connected to the other ends of the arms a, a', respectively, to the inner surface of a side panel c' of the cabinet c and the inner surface d' of the lid d by means of respective screw g and h.

A conventional stay as described above has a drawback that the operation for fitting it to a cabinet and a lid is very cumbersome and time consuming because the arms a, a' can constitute obstacles when the metal fitting members e, f are respectively being fitted to the cabinet c and the lid d with screws as the arms a, a' and the metal fitting members e, f have been connected to form a unit and the stay can not be accurately positioned for fitting and, consequently, its function as well as its effectiveness can be deteriorated.

Figure 7:
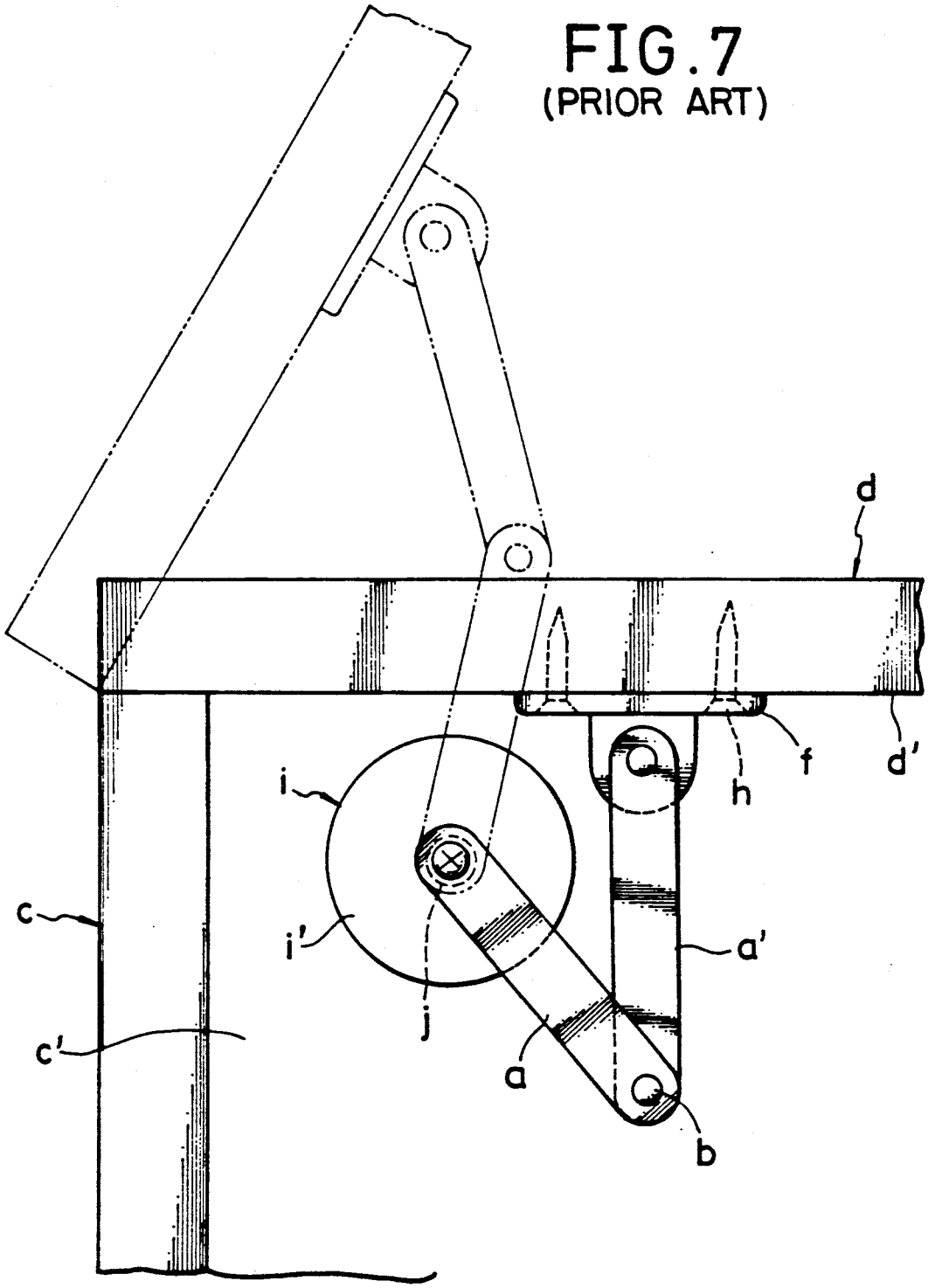
FIG. 7 (PRIOR ART)

FIG. 7 illustrates a conventional stay provided with a damper. While such a stay also comprises a pair of arms a, a' articulately connected with each other at one pair of ends by a shaft b functioning as an axis of rotation so that the arms can rotate relative to each other, the second end of the arm a is normally connected with a movable shaft provided at the center of the damper i. The lid d is fitted to the cabinet c by using such a stay in such a manner that the lid d becomes swingable and capable of being held at a given open position by firmly fitting a metal fitting member f swingably attached to the second end of the arm a' and a metal fitting member (not shown) attached to the main body i' of the damper i respectively to the inner surface d' of the lid d and the inner surface of a side panel c' of the cabinet c by means of fasteners h.

With a known stay having a damper as described above, the efficiency of transmitting power to rotate the movable shaft j by way of the arm a that moves as the lid d is being opened or closed is significantly lower and the operation of opening or closing the lid gives a very heavy feeling to the operator since the arm a is firmly fitted to the movable shaft j located at the center of the damper i Moreover, the arms a, a' can be undesirably rotated relative to each other around the axis of rotation when the weight of the lid is significant because the arms are connected only by the shaft b that functions as axis of rotation so that the lid d can eventually be no longer held to its open position. If a damper having a large damping effect is used to avoid this problem, then the operation of opening and closing the lid can become even more heavier.

According to the present invention, a stay comprising a pair of arms having first and second ends is provided with their respective first ends articulately coupled with each other and the second ends respectively fitted to a side panel of a cabinet and a plate lid by means of respective metal fitting members for opening the lid by a desired angle and retaining it in that open position until it is closed. One of the metal fitting members for fitting one of the arms is constituted by a metal joint to be swingable fitted to an end of the arm and a metal fixture to be rigidly fitted to the plate lid by screws and with the metal joint and metal fixture being removably coupled together.

Further, a stay comprising a pair of arms is provided with respective first ends pivotally coupled with each other and the second ends respectively fitted to a side panel of a cabinet and a plate lid by means of respective metal fitting members for opening the lid by a desired angle and retaining it in that open position until it is closed. A damper is fitted to one of the arms with the arm projecting from an eccentric section integrally formed with the main body of the damper having a movable shaft removably connected with and supported by the metal fitting member and an adjuster screw is revolvably driven into the main body for adjusting the angle with which the lid is retained at an open position, a retaining member being arranged on the metal fitting member for abutting the screw when the lid is retained at the open position.

When a lid is fitted to a cabinet by using the stay of the present invention, the metal fixture of one of the metal fitting member provided at an end of the stay is firmly and rigidly fitted to a preselected position on the inner surface of either the lid or one of the side panels of the cabinet by means of screws and then the matching metal joint is coupled with the metal fixture in such a manner that the metal fixture and the metal joint are not be turned aside from the longitudinal axis of the stay.

When an end of the stay is rigidly fitted to the inside of the lid in a manner as described above, the lid can be swingably attached to the cabinet by rigidly fitting the other end of the stay to the inner surface of a side panel of the cabinet be means of screws.

When a stay according to the invention is used, only the metal fitting member separably arranged at an end of the stay opposite to the end where the damper is provided is fitted to a preselected position on the inner surface of either the lid or one of the side panels of the cabinet by means of screws and thereafter the movable shaft of the damper is securely connected with the metal fitting member so that the damper is supported by the metal fitting member.

When an end of the stay is rigidly fitted to the inner surface of, for instance, a side panel of the cabinet, the metal fitting member for the other end is fitted to the inner surface of the lid with screws to make the lid swingable relative of the lid with screws to make the lid swingable relative to the cabinet.

When the lid fitted to the cabinet is gradually opened by turning the former, the turning effort applied to the lid is transmitted to the eccentric section of the damper main body by way of the arms so that the main body is rotated around the movable shaft.

When the lid is turned by a predetermined angle, the tip of the screw driven into the eccentric section of the damper main body abuts the retaining member of the metal fitting member to block the lid against any further rotary movement and keep it at a position where the angle is maintained.

The angle formed by the lid and the horizontal side line of the cabinet can be altered by moving back or forth the screw in the eccentric section of the damper main body, while the angle can also be modified by adjusting the angle of the retaining member when the metal fitting member is rigidly fitted to the inner surface of a side panel of the cabinet to provide an easy angle regulating capability for the cabinet and lid using a stay according to the invention.

The present invention now will be described in greater detail by referring to the accompanying drawings which illustrate a preferred embodiment of the invention.

As illustrated in FIGS. 1 through 5, first and second arms 1, 2 are articulately connected with each other at their first ends by means of a shaft 3 so that they can turn relative to each other around the shaft 3.

The arm 1 extends from the main body 4*a* of a damper 4, which is rotatably supported by a metal fitting member 5.

Figure 3A:
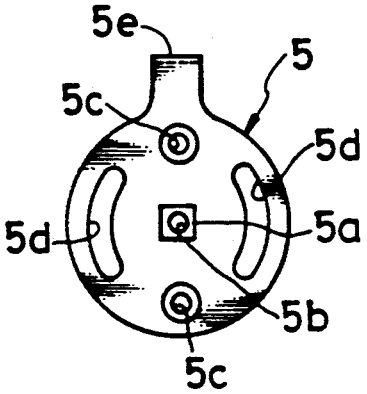
FIGS. 3(*a*) and 3(*b*) respectively show a front view of the other metal fitting member and that of the oil damper of the embodiment.
Figure 3B:
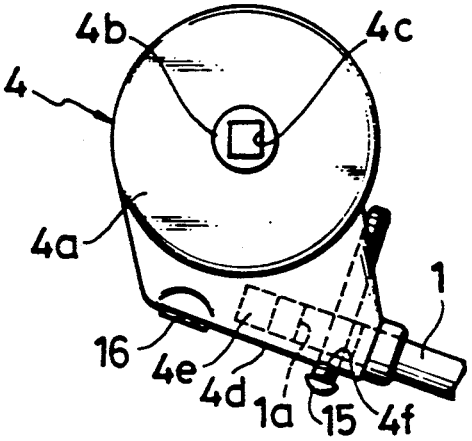
Figure 5:
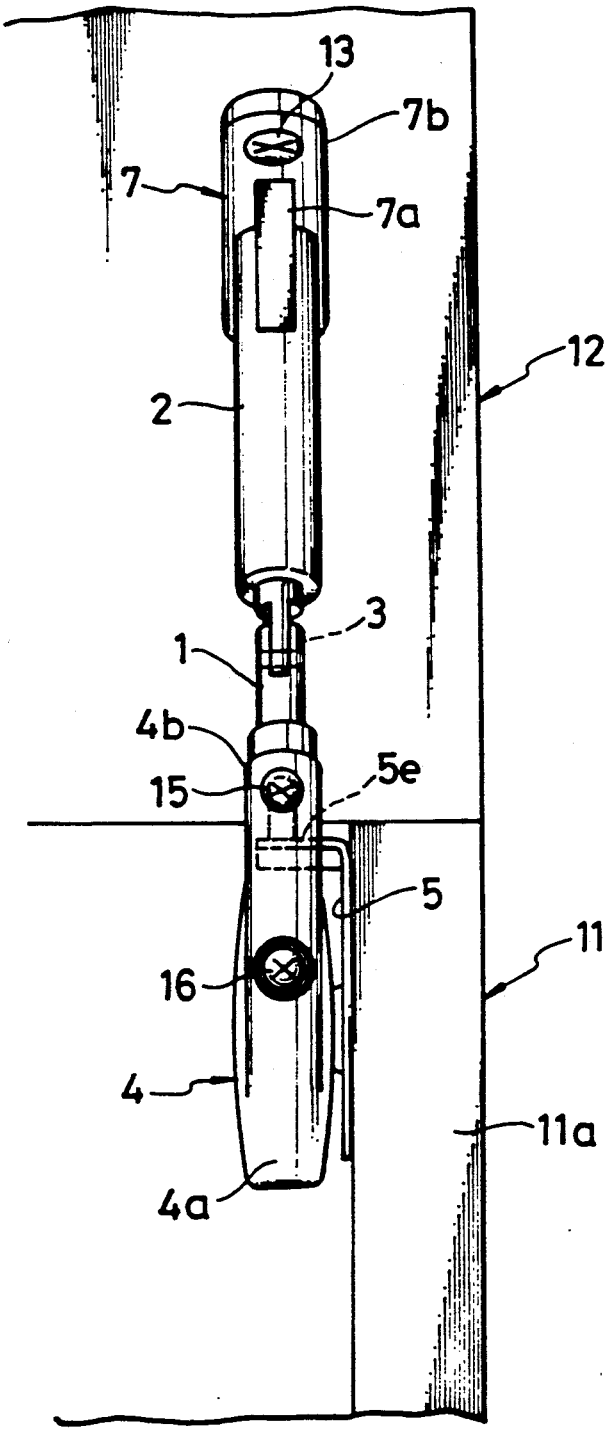
FIGS. 4 and 5 respectively show a side view of the cabinet and the lid provided with the embodiment and a front view of the cabinet with the lid retained in a open position.
Figure 4:
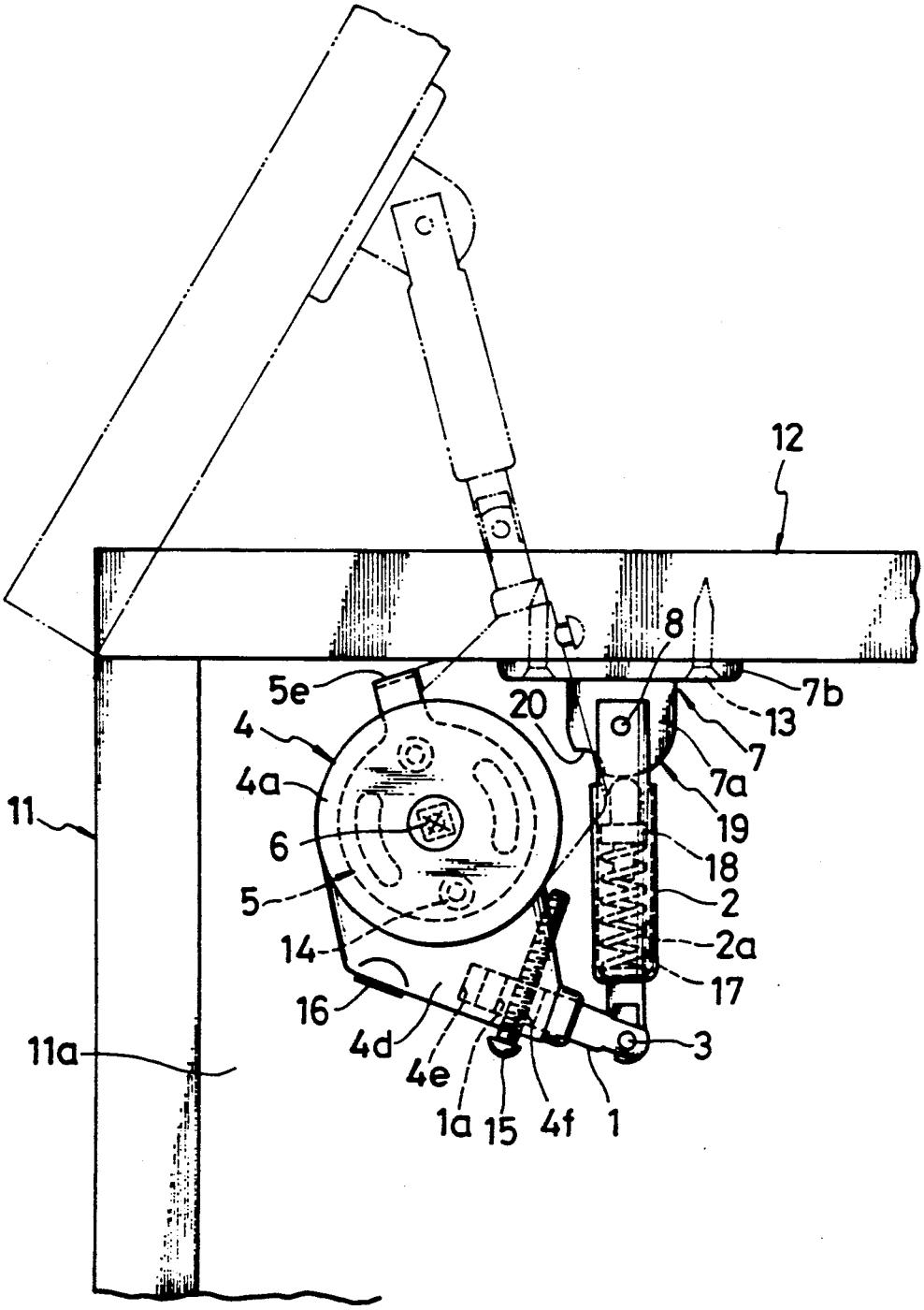

More specifically, as illustrated in FIGS. 3(*a*) and 3(*b*), the movable shaft 4*b* of the damper 4 has a square through bore 4*c* running therethrough, into which a square shaft 5*a* projecting from the metal fitting member 5 is removably fitted, while a setscrew 6 is driven into a tapped hole 5*b* bored from an end of the square shaft 5*a* in such a manner that the main body 4*a* of the damper 4 is rotatably supported by the metal fitting member 5 and consequently the plate lid 12 is kept to its open position by the resistance of the damper.

An eccentric section 4*d* radially projects from the main body 4*a* of the damper 4 and is integrally formed with the damper 4. The arm 1 is fitted into a lateral hole 4*e* bored in said eccentric section 4*d* so that the arm 1 projects lengthwise outwardly from the eccentric section 4*d*.

Figure 1:
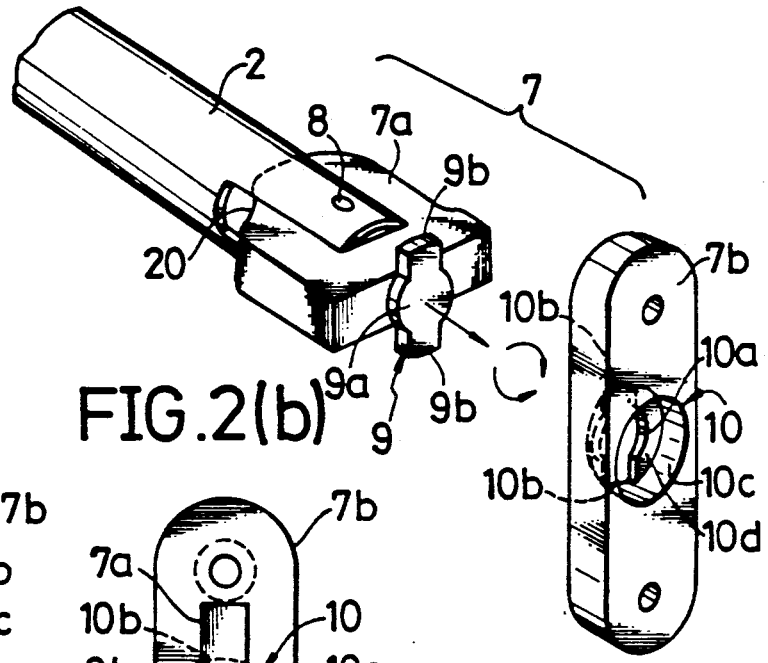
FIG. 1 is fragmentary exploded perspective view of a first arm of the stay according to the invention.

On the other hand, as shown in FIG. 1, the other end of the second arm 2 is provided with a metal fitting member 7, which is constituted by a metal joint 7*a* and a metal fixture 7*b*, of which the metal joint 7*a* is rotatably fitted to the other end of the arm 2 by a rotary shaft 8 such as pin.

In this embodiment, metal joint 7*a* is realized in the form of a thick plate provided with a connector 9 projecting perpendicularly to the main surface of the metal joint 7*a* from the central area of one of its lateral sides.

Connector 9 has a circular middle portion 9*a* having a relatively large diameter and a pair of engaging projections 9*b*, 9*b* symmetrically arranged and connected to a middle portion 9*a*.

The metal fixture 7*b* is designed to receive connector 9 and is in the form of an oblong thick plate having a central bore 10 into which the connector 9 is engagedly fitted.

More specifically, the bore 10 comprises a smaller bore 10*a* for receiving the circular middle portion 9*a* of the connector 9, a pair of slits 10*b*, 10*b* symmetrically and radially extending from smaller bore 10*a* in the axial direction for respectively receiving the engaging projections 9*b*, 9*b* and a larger bore 10*c* being coaxial with the smaller bore 10*a* and smaller bore 10*a* combined with said axial slits 10*b*, 10*b* being capable of removably receiving the connector 9.

Figure 2A:
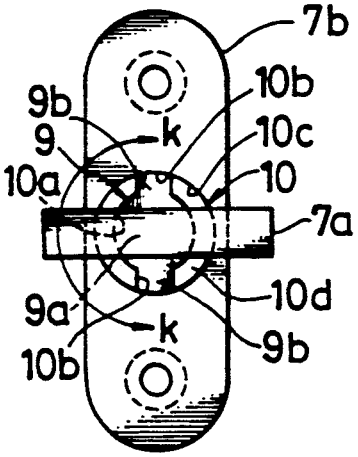
FIGS. 2(*a*) and 2(*b*) are two different front views of one of the metal fitting members of the first arm illustrating how its separable components are coupled together.
Figure 2B:
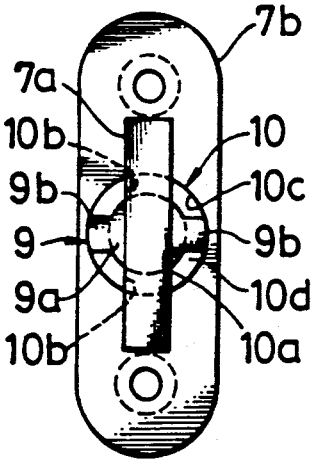

With such an arrangement, when the connector 9 is introduced into said bore 10 with the axial slits 10*b*, 10*b* respectively aligned with projections 9*b*, 9*b*, the connector 9 comes to be engaged with the combination of the smaller bore 10*a* and the slits 10*b*, 10*b* as illustrated in FIG. 2(*a*). If, under this condition, the metal joint 7*a* is rotated either clockwise or counterclockwise as indicated by arrows k, k' by a certain angle (90° in the case of FIG. 2(*a*)), the projections 9*b*, 9*b* are circularly moved to the respective positions so that they abut the bottom 10*d* of the larger bore 10*c* and the metal joint 7*a*, which is now axially aligned with the metal fixture 9*b*, is securely held by the metal fixture 9*b* and unable to come off, the then established connection between connector 9 and fixture 7*b* comprising a releasable twist lock connection defining a relative rotation pivot axis of release therefor disposed in the plane of the arms 1 and 2 and which connection may be released only if one of the shaft 3, shaft 8 or arm 1 is removed and the arm 2 is rotated relative to the metal fixture 7*b* about an axis coinciding with the center axis of bore 10*c*.

If the metal joint 7*a* is rotated until the projections 9*b*, 9*b* are aligned with the slits 10*b*, 10*b*, the metal joint 7*a* can be separated from the metal fixture 7*b*.

It may be needless to say that the arrangement of a metal joint 7*a* and a metal fixture 7*b* for removably connecting them is not limited to that of the present embodiment and a number of different modifications and alternatives may be conceivable for it. For instance, they may be removably connected together by a combination of a bolt and a nut or a combination of a ball-shaped projection and a slitted elastic spherical chamber for receiving the projection.

For swingably and retainably fitting a hinged plate lid 12 to a cabinet 11 by using a stay having a configuration as described above, the metal fixture 7*b* is rigidly fitted to the inner surface of the plate lid 12 in advance in a desired direction by means of screws 13, the connector 9 is fitted into the central bore 10 as in the above embodiment and then the metal fixture 7*b* is securely connected with the metal joint 7*a* by rotating the latter.

Thereafter, the metal fitting member 5 is rigidly fitted to the inner surface of a lateral plate 11*a* of the cabinet 11 by means of screws 14, the square shaft 5*a* is fitted into the square through bore 4*c* of the movable shaft 4*b* and setscrew 6 is driven into the square shaft 5*a* to complete the operation of fitting the plate lid 12 to the cabinet 11.

While the connector 9 is arranged on the metal joint 7*a* and the central bore 10 is formed on the metal fixture 7*b* in the above embodiment, conversely the connector 9 may be arranged on the metal fixture 7*b* and the central bore 10 may be formed on the metal joint 7*a*.

If the oil damper 4 is omitted from this assembly, the second end of the arm 1 should be directly and rotatably fitted to the metal fitting member 5.

It should be noted that, in the above embodiment, the arm 1 is axially slidably fitted into said lateral hole 4*e* and the arm 1 is provided with a fitting aperture 1*a* running through the arm 1 in the direction perpendicular to the axis of the arm 1 and having an axially oblong contour, while said eccentric section 4*d* is provided with a tapped through bore 4*d* running approximately perpendicular to the lateral hole 4*f* for receiving an adjuster screw 15 designed for adjusting the angle by which the plate lid is opened, the adjuster screw 15 being also running through the fitting aperture 1*a* so that the arm 1 is rigidly fitted to the eccentric section 4*d* of the main body 4*a* of the damper by means of a fitting screw (not shown) in such a manner that the length of the arm 1 can be adjusted within a limit defined by the effective width of the fitting aperture 1*a*.

On the other hand, the metal fitting member 5 is roughly realized in the form of a disc whose periphery coincides with a circle drawn around the square shaft 5*a*. The metal fitting member 5 is provided with a pair of circular screw holes 5*c*, 5*c* arranged symmetrically relative to the square shaft 5*a* and another pair of oblong screw holes 5*d*, 5*d* running along the periphery of the metal fitting member 5 for tentatively fitting the member 5 in order to adjust its angular position as well as a holder section 5*e* which is integrally formed with the member 5 and radially projecting from the periphery of the main body of the member to abut the front end of the adjuster screw 15.

Thus, the adjuster screw 15 and the retaining member 5*e* form a retainer for keeping the plate lid at an open position separated from the cabinet by a desired angle.

Besides, the damper 4 is provided with another adjuster screw 16 at its eccentric section 4*d* for adjusting its damping force.

The arm 2 has an inner hollow area 2*a* for accommodating a compression spring 17, by means of which a slider member 18 located in the arm 2 is axially slidably biased toward the metal joint 7*a*. The semispherical front end portion of the slider member 18 slidably abuts the rounded peripheral surface 19 of the metal joint 7*a*.

A recess 20 is formed at an appropriate location of the rounded peripheral surface 19, or a part of the rounded peripheral surface 19 that comes to directly face the slider member 18 when the plate lid 12 is opened by the desired angle in order to releasably lock the slider member 18.

Therefore, when the plate lid 12 is opened by the desired angle, the recess 20 comes to be engaged by the slider member 18 so that the plate lid 12 is held to that open position by the retainer constituted by the screw 15 and the retaining member 5*e*.

For swingably and retainably fitting a hinged plate lid 12 to a cabinet 11 by using a stay having a damper as described above, the metal fixture 7*b* is rigidly fitted to the inner surface of the plate lid 12 in advance in a desired direction by means of screws 13, the rotary shaft 8 is fitted into the central bore 10 as in the above embodiment and then the metal fixture 7*b* is securely connected with the metal joint 7*a* by rotating the latter.

Thereafter, the metal fitting member 5 is rigidly fitted to the inner surface of a lateral plate 11*a* of the cabinet 11 by means of screws 14, the square shaft 5*a* is fitted into the square through bore 4*c* of the movable shaft 4*b* and setscrew 6 is driven into the square shaft 5*a* to complete the operation of fitting the plate lid 12 to the cabinet 11.

Since a stay according to this invention has a configuration as described above, it can be fitted to a cabinet without any difficulty so that the lid may be opened by a desired angle and kept there until it is closed by simple attaching the metal fixture of one of its fitting member onto the lid for coupling the metal fixture and the corresponding metal joint and thereafter affixing the other metal fitting member to the side wall, for example of the cabinet. Therefore, arms and other components of the stay will not constitute any obstacles when one of the metal fitting members is attached to the lid while the components remain in a loose state and consequently the operation of fitting the say can be carried out quickly and accurately.

When a stay according to the present invention is fitted to a cabinet so that the lid may be opened by a desired angle and kept there until it is closed said desired angle is defined by the retaining member of one of the metal fitting member and the adjuster screw when they abut on each other and can be modified by revolving the adjuster screw. Moreover, the turning effort applied to the lid is effectively transmitted to the damper as it reaches the eccentric section of the damper in the first place by way of a pair of arms so that the lid can be opened or closed smoothly with a minimum effort. Besides, since the desired angle of opening of the lid is defined by the adjuster screw and the retaining section, the arms may be articulately connected simply by means of a pin to achieve a structural simplicity of the stay. The retaining mechanism is realized with ease by arranging the adjuster screw and the retaining section respectively on the eccentric section of the damper main body and the metal fitting member.

What is claimed is:

1. A stay comprising first and second arms having respective first and second ends with their respective first ends articulately coupled with each other and said second ends respectively fitted to a side panel of a cabinet and a plate lid by means of respective metal fitting members for opening the lid by a desired angle and releasably retaining it in that open position until it is closed, a damper including a main body, said damper being fitted to the second end of one of said arms, said first arm projecting from an eccentric section integrally formed with said main body of said damper having a movable shaft removably connected with and supported by the corresponding metal fitting member, an adjuster screw revolvably driven into said main body for adjusting the angle with which the lid is retained at an open position, and a retaining member being arranged on said corresponding metal fitting member for abutting said adjuster screw when the lid is retained at the open position.

2. The stay of claim 1 wherein one of the metal fitting members for fitting one of the arm second ends is constituted by a metal joint to be swingably fitted to the corresponding end of said one arm and a metal fixture to be rigidly fitted to the plate lid by means of screws, said metal joint and said one metal fitting fixture being removably coupled together by a twist lock connection defining a relative rotation pivot axis of release therefor disposed in the plane of said arms.

3. The stay of claim 2 wherein said metal joint and said corresponding end of said one arm include coacting detent means operative to yieldingly retain said metal joint in a predetermined swung position relative to said corresponding end of said one arm.

* * * * *